US007121587B2

(12) United States Patent
Mark

(10) Patent No.: US 7,121,587 B2
(45) Date of Patent: Oct. 17, 2006

(54) WEARABLE BOOK

(76) Inventor: Julia B. Mark, 1104 NW. 15th Ave., Suite 300, Portland, OR (US) 97209

( * ) Notice: Subject to any disclaimer, the term of this patent is extended or adjusted under 35 U.S.C. 154(b) by 90 days.

(21) Appl. No.: 10/825,835

(22) Filed: Apr. 15, 2004

(65) Prior Publication Data

US 2004/0174009 A1 Sep. 9, 2004

(51) Int. Cl.
*B42D 1/00* (2006.01)
*B42D 5/00* (2006.01)

(52) U.S. Cl. ..... 281/15.1; 281/21.1; 281/45; 224/172; 224/175; 224/222; 224/603; 224/604; 224/605; 224/219; 224/220; 40/586; 40/633; 40/634; 40/904; 63/3.1; 63/3.13; 63/3.2; 63/3.3; 63/3.4; 63/5.1; 63/5.2; 211/45; 434/317; 402/57; 403/220; 403/229; 294/138; 294/141; 294/150; 294/151

(58) Field of Classification Search ..... 281/15.1, 281/21.1, 45; 224/151, 153, 172, 175, 222, 224/603, 604, 605, 219, 220; 294/138, 141, 294/150, 151; 402/57; 211/45; 434/317; 403/220, 229; 63/3.1, 3.13, 3.2, 3.3, 3.4, 63/5.1, 5.2; 40/586, 633, 634, 904
See application file for complete search history.

(56) References Cited

U.S. PATENT DOCUMENTS

| | | | | | |
|---|---|---|---|---|---|
| 897,332 | A | * | 9/1908 | Wilson | 402/74 |
| 1,407,239 | A | | 2/1922 | Weiss | |
| 1,419,190 | A | * | 6/1922 | Zipoy | 281/44 |
| 1,438,145 | A | * | 12/1922 | Swartz | 224/220 |
| 1,594,215 | A | | 7/1926 | Sides | |
| 2,270,213 | A | * | 1/1942 | Deusch | 294/138 |
| 2,421,487 | A | * | 6/1947 | Dyck | 281/50 |
| 3,087,498 | A | * | 4/1963 | Vogel | 402/22 |
| 3,202,331 | A | | 8/1965 | McKinstrie | |
| 4,165,890 | A | * | 8/1979 | Leff | 283/46 |
| 4,395,057 | A | * | 7/1983 | Young | 281/42 |
| 4,500,223 | A | * | 2/1985 | Downing et al. | 402/20 |
| 4,642,054 | A | * | 2/1987 | Wada | 434/178 |
| 4,819,963 | A | * | 4/1989 | Wolski | 281/15.1 |
| 4,824,140 | A | | 4/1989 | Rankin | |
| 4,874,340 | A | * | 10/1989 | Smallwood | 446/28 |
| 4,903,932 | A | * | 2/1990 | Stewart, Jr. | 248/444 |
| 4,958,759 | A | | 9/1990 | Jarvis | |
| 4,988,229 | A | * | 1/1991 | Ramsey, III | 402/4 |
| 5,215,237 | A | * | 6/1993 | Wu | 224/230 |
| 5,291,755 | A | * | 3/1994 | Grant | 63/23 |
| 5,386,933 | A | | 2/1995 | Greene et al. | |
| 5,421,616 | A | * | 6/1995 | Laubacher | 281/45 |

(Continued)

FOREIGN PATENT DOCUMENTS

GB 2362352 A * 11/2001

(Continued)

*Primary Examiner*—Monica Carter
*Assistant Examiner*—Mark Henderson
(74) *Attorney, Agent, or Firm*—Birdwell & Janke, LLP

(57) ABSTRACT

A wearable book. A wearable book, comprising a plurality of pages and a loop adapted for encircling a body portion for attaching said pages to the body, is provided. The pages are preferably bound together at one edge and preferably are of substantially the same size. The loop preferably has at least about 50% elasticity for stretching the loop over a second body portion such as a hand having a substantially larger circumference than a first body portion such as a wrist, and thereafter snugly circumferentially contacting the first body portion to secure the book in place.

37 Claims, 1 Drawing Sheet

U.S. PATENT DOCUMENTS 5,456,497 A * 10/1995 Ross, Jr. ..... 281/42
5,474,332 A * 12/1995 Yeh ..... 281/19.1
5,531,481 A 7/1996 Wiltshire
5,622,385 A * 4/1997 Yeh ..... 281/19.1
5,676,482 A * 10/1997 Hawkins ..... 402/79
5,769,477 A 6/1998 Lehrer
5,795,090 A * 8/1998 Jackson ..... 402/79
D417,889 S * 12/1999 French ..... D19/26
D435,268 S * 12/2000 Browning ..... D19/26
6,158,884 A 12/2000 Lebby et al.
6,234,534 B1 * 5/2001 Warren ..... 281/37
6,381,891 B1 * 5/2002 Hazel ..... 40/640
6,419,493 B1 * 7/2002 Cole ..... 434/81
6,425,137 B1 * 7/2002 Fakhrai ..... 2/170
6,530,509 B1 * 3/2003 Davis ..... 224/219
6,644,694 B1 11/2003 Seawright
6,773,034 B1 * 8/2004 Melcher ..... 281/38
2002/0113426 A1 * 8/2002 Lang ..... 281/15.1
2004/0144815 A1 * 7/2004 Reid ..... 224/222
2005/0230955 A1 * 10/2005 Mashimo ..... 281/21.1

FOREIGN PATENT DOCUMENTS

JP 2004001539 * 3/2004

* cited by examiner

WEARABLE BOOK

FIELD OF THE INVENTION

The present invention relates to a wearable book.

BACKGROUND

There are a number of different methods that have been used by people who wish to carry an information source such as a book with them as they walk, travel, etc. Book bags and briefcases are frequently used for this purpose, but there are a number of more specialized solutions that have been devised. For example, Jarvis, U.S. Pat. No. 4,958,759, describes a combined book cover and book carrier whereby books may be carried by the user in the hand, on the wrist, over the shoulder or as a backpack. However using this method, the book is inaccessible while being carried and must be removed from the carrier before it can be consulted. This inaccessibility is a problem common to many of the usual methods for carrying books such as book bags or briefcases, all of which do not provide for access to the information contained within the book while the book is in the carrying device. Another problem with these common methods for carrying information is in the nature of the book itself, books often being made of paper unsuitable for use in poor weather, such as under wet conditions. Books are often difficult to use when it is desired to keep at least one hand free of the book for holding other objects. It is often difficult to turn the pages of books without use of both hands, and many books cannot be kept open at a given page without constant holding by the hands or by the use of a clip or other similar device.

Attempts have been made to solve the problems of difficult access, weather resistance, and the freeing of hands for other uses while accessing the printed material. Greene, U.S. Pat. No. 5,386,933 proposes a "map mounting system for strap application", which is an integral map holding and mounting system that allows a map or other printed matter to be enclosed within a holder and worn on a user's limb for immediate referral during activities such as skiing. The holder is adapted to display a map or printed matter such as a trail map under a transparent sheet of plastic. However the area available for display of the map or printed matter is extremely limited, the apparatus only being able to display a single small area sealed within the holder and with no provision being made for readily changing the page while under wet or otherwise adverse conditions. The strap, which is attached to the wearer and tightened by means of a buckle, makes it relatively difficult to take the holder off, put it one, or to reposition the holder from one part of the body to another when the wearer wishes to do so.

Seawright, U.S. Pat. No. 6,644,694 describes a foldable, weather-resistant reference guide for wearing on an arm, torso, or leg. The reference material it carries, such as a map, folds up when not in use. The reference material after folding is secured by a keeping member into a small packet which is secured to the user's body by a buckled strap. However here the reference material must be unfolded to view the data recorded on it, which is disadvantageous for convenient use. Furthermore, the amount of information that may be displayed is limited by the size of the single, folded surface. Also, the totality of information that the user might wish to access must be displayed on the single surface, and it is impossible to change one portion of the display without changing the entire display. It is also inconvenient under some circumstances to unfold a relatively large single sheet, for example under windy conditions. The means of attachment to the wearer also suffers from the defect of being difficult to don, doff, or reposition, requiring unbuckling and re-buckling, which can be a troublesome operation to carry out with a single hand if the apparatus is worn around a wrist.

Therefore, there is a need for a wearable book of pages that provides a readily accessible source of reference information that may be accessed under conditions when the user is also engaged in other activities or is under wet or otherwise adverse conditions, that is easy to don, doff, or reposition, that is attached to the wearer's body in a comfortable, secure way, and that is capable of providing a relatively large selection of images and information under those conditions.

SUMMARY OF THE INVENTION

According to the present invention a wearable book, comprising a plurality of pages and a loop adapted for encircling a body portion for attaching said pages to the body, is provided. The pages are preferably bound together at one edge and preferably are of substantially the same size. The loop preferably has at least about 50% elasticity for stretching the loop over a second body portion such as a hand having a substantially larger circumference than a first body portion such as a wrist, and thereafter snugly circumferentially contacting the first body portion to secure the book in place.

DETAILED DESCRIPTION OF PREFERRED EMBODIMENTS

Figure 1:
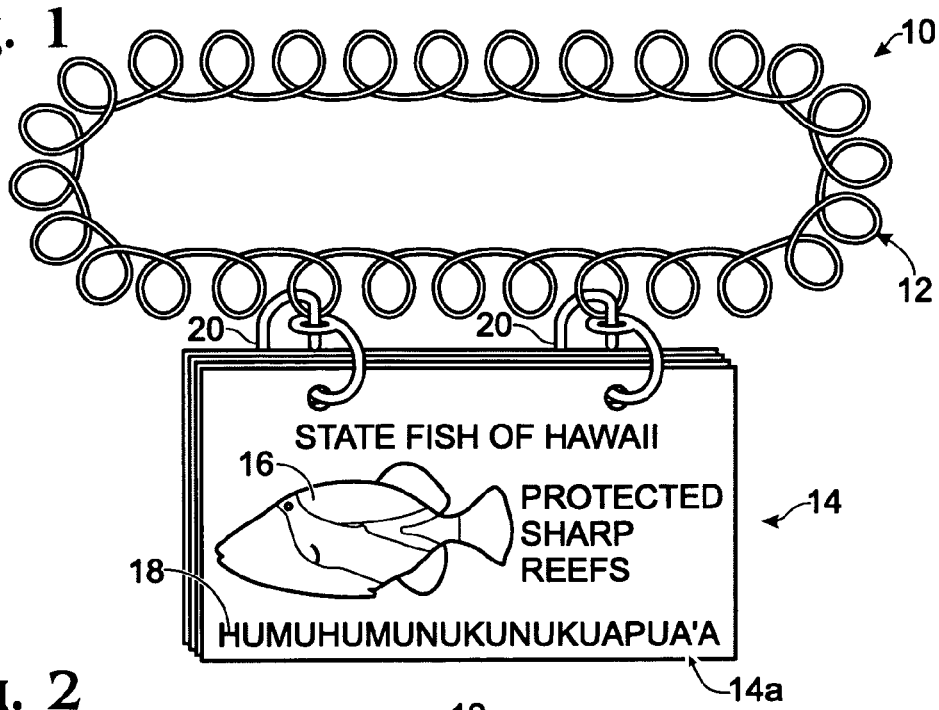
FIG. 1 shows a perspective of a preferred embodiment of a wearable book according to the present invention.

FIG. 1 shows a preferred embodiment of a wearable book 10 according to the present invention. The wearable book comprises pages 14 that can be made to come successively or in some other selected order into view. The pages 14 bear information which can be any images, symbols, or words, for example images 16 or text 18. The information preferably provides useful facts or indications about a subject of interest, but this is not essential. The pages are generally of substantially uniform size and shape, but variations may be present, for example as an aid to finding a particular page from among the plurality of pages.

The pages 14 bear information by displaying the information using any known display means, such as printing, lithography, photocopying, engraving, or electronically controlled electrical display elements. The pages include a display surface 14*a* adapted for the display means. For example, where the display means is printing, the display surface is adapted to receive and retain ink. As another example, where the display means is electronic control, the display surface includes electrical display elements. Therefore the pages include materials suitable for the means of display. The display surface may be a layer of a multi-layer page.

Depending upon the use for which the particular pages are designed, they also have suitable physical properties for that use. For example, if the pages will be used under wet conditions such as when snorkeling or hiking, any printed pages are preferably constructed of water-resistant materials and the images or text printed thereon with waterproof inks or toners, and any electronic pages are preferably waterproofed. Alternatively, pages may be protected by water-resistant coatings or layers, such as by lamination between transparent plastic sheets.

Preferably, printed pages for applications where pages may be exposed to moisture are constructed of synthetic paper, for example a synthetic paper marketed as Yupo® by Yupo Corporation of America (http://yca.yupo.com/cpm/products/, 1-888-USE-YUPO, 800. Yupo Court, Chesapeake, Va. 23320). Synthetic paper may or may not include a core which is coated by a layer suitable for receiving printing inks. Synthetic papers are generally formed of synthetic polymers instead of the cellulose which makes up natural paper. These synthetic polymers generally impart a high degree of water resistance. Synthetic paper may be formed of webs of fibers of synthetic polymers or may be formed of sheets of synthetic polymers of various thicknesses and compositions bonded together.

The pages, while generally of a substantially uniform size and shape, may also have tabs or other such aids to indexing such as a distinct size or shape to assist a user in flipping through a book of pages to find the surface of interest and to examine the information. The tabs or other indexing features may themselves display indexing information enabling a user to more quickly find the page of interest. Some of the pages may bear information that allows more detailed information to be quickly found on other pages, such as indices or tables of contents.

A preferred use of the pages is for identifying natural and artificial objects by comparing the objects with pictures or images of the objects displayed on the pages. Examples of natural objects are animals, plants, geological features, atmospheric features, celestial features, etc. Examples of artificial objects are structures, automobiles and motorcycles, aircraft, ships, artwork, unfamiliar road and trail signs such as those used in foreign countries, etc. The pages would preferably display a variety of the given type of object so that a comparison can be made to an observed object. The pages of this type are used by the viewer by searching through the pages until a page is found that bears an image that corresponds to the object the viewer is observing. The pages would also preferably identify the object or provide other information about the object in symbolic or textual form.

It is often the case that the objects are located in an environment in which the pages will be exposed to harsh environmental conditions, for example, sun, wind, and rain. In this situation, pages are preferably resistant to the effects of these conditions, such as by being made ultraviolet light resistant, water resistant, or heavy and stiff enough to resist being blown about in wind. In addition, for identifying marine objects, such as fish and marine invertebrates or plants, the pages should be completely waterproof Preferably the pages are waterproof so that they can be used while snorkeling or scuba diving, to identify marine animals.

The pages may be adapted to display objects indigenous to a particular region or area to which the book is adapted for use. For example, for use by snorkelers, the images may be limited to those that are representative of the types of fish and marine invertebrates found in the waters in which the snorkeler is swimming. This assures a higher probability that the object being searched for will be among the totality of objects shown on the pages.

The pages should preferably be printed in a format clear enough to be read in the outdoors under less than perfect lighting conditions, and on material heavy enough to prevent their being easily blown around. If pages are designed to be viewed under poor light, they may be printed using fluorescent or luminescent inks to make the images or text more legible under those conditions. While they may be of a range of sizes, the pages should preferably be smaller in size than pages used in books of typical field guide size, i.e., smaller than about 5×8 inches.

For pages to be used as foreign language aids, images showing common situations and words relevant to that situation, such as when ordering food in a restaurant, as well as direct translations of commonly used words, are displayed. The pages are preferably ordered in some rational sequence related to what a traveler in a foreign land might need; for example pages about checking into a hotel being located physically close to pages about dealing with hotel situations such as ordering from room service, all the pages giving useful words and phrases in the foreign language in question. Here a viewer would find a page, preferably using indexing features, that corresponds to the situation in which the viewer finds himself or herself, and on that page would be shown foreign language words and phrases appropriate to the situation. For example, a page displaying information about ordering in a French restaurant would show the names of various foods, and various useful phrases for dealing with waiters, in the French language.

Pages that might be used when traveling show information about traffic signs, maps, road conditions and other relevant data, and are likewise ordered on some rational basis, such as road conditions that might be encountered on a given route. For example, the international road sign conventions, which are not generally used in the United States, would be useful to travelers in Europe. When confronted with an unfamiliar road sign instructing traffic behavior, a viewer could quickly determine its meaning by referring to the appropriate page. Similarly, road signs in a foreign language could be translated by referring to a page bearing the English language equivalents.

Pages for instructing children show school subjects such as the alphabet, multiplication tables, etc., and the pages in a given book are preferably grouped to be age-appropriate. Pages for amusing children, for example on road trips, can include games or cartoons which are preferably age-appropriate and popular with the target audience of children. Such pages would also be constructed of materials resistant to handling by children.

While the pages primarily display information of various types, they may also be adapted to be written or drawn on by the user without departing from the principles of the invention. For example, pages bearing information that would be useful to drivers on the Autobahn in Germany could also provide space thereon where notes could be taken by travelers about features or situations along the route that the traveler might subsequently wish to refer to.

Electronic pages may also be used to provide information that, as distinct from printed pages, may change over time. For example, a page incorporating Global Positioning System information gives a user access to the user's current location as well as vectors or maps for travel. A page incorporating a text messaging feature shows text messages a user may receive by wireless means. A page associated with an appropriate mechanism shows a scuba diver his or her dive profile, i.e. the times spent at various depths underwater. An internet website page shows the contents of any selected website received by wireless means, such as weather reports from a weather website. It is consistent with the principles of this invention that the book comprises both printed and electronic pages.

The pages are preferably discretely manufactured articles and attached to one another by being bound together, but may be defined in or on a larger integrally manufactured article by fold-lines, such as in a folded map, Z-fold paper, or graphically, such as on a continuous roll of material which is unwound for reading where individual images are presented as frames or panels. By any of the above-mentioned means and any other means known in the art, pages can be "opened" and selected for viewing and "closed" when the viewing is complete. The information-bearing page desired to be consulted by the user at any particular time may thus be selected from among the totality of pages in the wearable book and viewed to obtain the information sought.

One outstanding advantage of the present invention is that an elastic loop is provided that allows the book to be put on, repositioned, or taken off without opening and closing a clasp, snap, or buckle, but nevertheless securely and comfortably holds the book in place while being worn. A preferred elastic loop 12 is shown in FIG. 1. The loop 12 requires no buckles for attachment or adjustment, although buckles, snaps, or similar features may be incorporated into the loop without departing from the principles of the present invention. The loop provides for encircling a portion of the body where the wearable book 10 is to be worn, which is typically a wrist, arm, ankle, or leg, but could be a neck, waist, or torso. The loop may obtain its elasticity and flexibility from its material of construction, its physical configuration, or both. For example, if an elastomeric material such as an elastic synthetic or natural polymer is used, sufficient elasticity and flexibility may be imparted thereby such that no additional physical configuration is required. Alternatively, flexibility and elasticity can be conferred by use of a physical configuration, for example a helical, spring-like shape, even if the material of construction is insufficiently elastic or flexible. Thus, the loop is preferably made of plastic due to its ease of manufacture from one of the numerous different types of plastic with various flexible and elastic properties and the ease of forming plastic into shapes that impart flexibility and elasticity, but it may be made of metal, rubber or other materials, or a combination thereof, with similar properties without departing from the principles of the invention. The configuration of the strand of material comprising the loop is preferably a helical spring-like shape, which assists in the elastic stretching of the loop while being donned but which constricts upon release to prevent inadvertent loss, but other configurations that allow for elasticity are not inconsistent with the present invention. For example, the plastic may be of a flat sinusoidal configuration that provides for flexibility and elasticity.

The loop preferably fits snugly around the desired body portion when supporting the weight of the pages. More specifically, while supporting the weight of the pages in any orientation of the body portion to which the loop is attached, the loop preferably makes contact with the body portion substantially around the entire circumference thereof. It is desired that the book not sag away from the body while it is being worn, perhaps allowing it to slip off the wrist or other position on the body, so the loop should be elastic enough to firmly hold the book of a given weight in position while it is worn, without unduly constricting the body part on which it is placed, cutting off circulation or being uncomfortable to wear. Thus, for a given book, the degree of elasticity and the size of the loop when relaxed may be tailored for maximum comfort to the user and effectiveness in carrying the weight of the pages, depending on the weight of the pages in the given book and the body part around which the book is designed to be worn.

Additionally, to provide for ease of attachment to and removal from the body, the loop is preferably sufficiently elastic to provide such a fit on a first body portion, e.g., the wrist, and still be able to stretch over an adjacent part body portion, e.g., the hand, having a larger circumference. It is believed that at least about 50% elasticity is desirable for this purpose. A preferred embodiment of the loop provides the desired elasticity in the form of the common plastic helical coils now popular on the market for carrying car keys.

Figure 2:
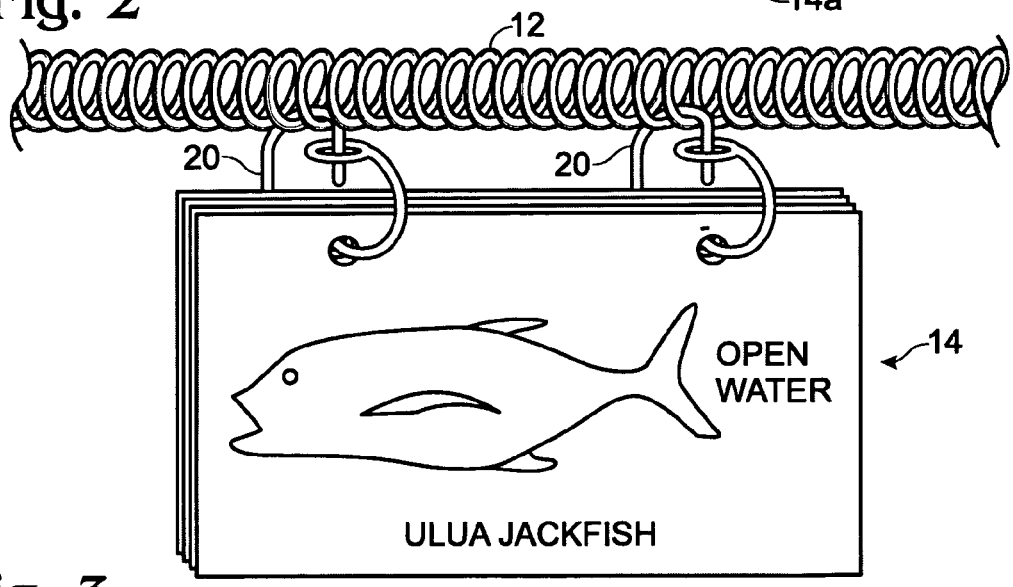
FIG. 2 shows a detail of a preferred embodiment of connectors attaching a plurality of pages to a loop.

A second outstanding advantage of the present invention is that a means is provided for attaching pages to a part of the user's body that also binds the pages together. In a basic embodiment of the present invention, the pages 14 are bound together with the loop 12. For example the loop may pass directly through holes in the pages 14. In a preferred embodiment, additional binding of the pages is provided. For example, connectors 20 such as plastic rings or tie tabs pass through holes in the individual pages and secure them to loop 12 as shown in FIG. 2, or alternatively the pages may be equipped with small rings or other types of connectors of their own through which the additional binding passes to secure the pages to the loop. Alternatively, the additional binding may be of a spiral type comprising a single plastic strap or metal wire that is helically passed through a series of holes or connectors in the pages. If the preferred tie tabs are used, they are preferably connected as shown in FIG. 2 wherein the loose ends of the tie tabs lie within the circle formed upon their closure and thus do not project outwards where they might scratch or poke the wearer. Whatever binding method is used, the individual pages are readily selected by the user and the book may be held open at a given page without difficulty.

Figure 3:
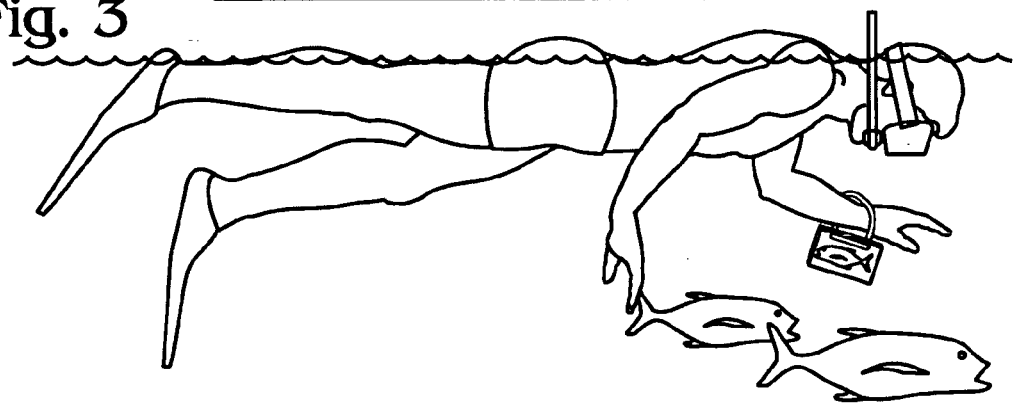
FIG. 3 shows a preferred embodiment as it may be used by a snorkeler.

The apparatus is readily donned by stretching the flexible, elastic loop and pulling it onto the desired part of the body. Due to the elastic nature of the loop, it then lightly constricts around the body to keep it in place, but may be repositioned by again pulling on the material to slightly expand it, pulling it to the new desired position, and releasing the loop to allow it to constrict back into position. To use the wearable book the user places the loop around a body part in a suitable position and then searches through the pages, flipping through them with a hand until the page of interest is found. Once the desired page is located, the user obtains the information needed therefrom. FIG. 3 shows a snorkeler consulting the book of pages showing images of fish in order to identify a fish that has been seen. Thus among other things, this invention provides a method and apparatus for carrying information-bearing pages for use as reference material while under wet conditions or when submerged.

The present invention of a wearable book thus solves the aforementioned problems associated with carrying and accessing printed information under conditions when the wearer is actively engaged in other pursuits such as walking, shopping, traveling, snorkeling, conversing with other people, or in any situation where convenience of quick access and the ability to use a hand for another purpose at the same time is important.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow. It will doubtless be obvious to those of ordinary skill in the art that there are other embodiments employing these principles that are not described in detail herein.

The invention claimed is:

1. A wearable book, comprising a plurality of pages having information thereon, connected by at least two spaced apart connectors to a loop, said loop being adapted for encircling a first body portion, wherein each of said pages has a size and a shape, wherein all of said pages have substantially the same said size and shape, said pages having corresponding first edges and being bound together at said first edges by said connectors, wherein said loop has at least about 50% elasticity, for stretching the loop over a second body portion having a substantially larger circumference than said first body portion and thereafter snugly circumferentially contacting said first body portion with said loop.

2. The wearable book of claim 1, wherein said connectors pass through said pages.

3. The wearable book of claim 1, wherein said pages and said information are substantially resistant to immersion in water.

4. The wearable book of claim 2, wherein said loop is coiled.

5. The wearable book of claim 2, wherein said pages and said information are substantially resistant to immersion in water.

6. The wearable book of claim 4, wherein said pages and said information are substantially resistant to immersion in water.

7. The wearable book of claim 6, wherein said information comprises text and pictures disposed on at least one of said plurality of pages.

8. The wearable book of claim 6, wherein said information comprises text, and at least one of said pages includes at least one word in a first language associated with an explanatory word in a second language different from said first language.

9. The wearable book of claim 6, wherein at least one of said pages includes a picture of an animal.

10. The wearable book of claim 6, wherein at least one of said pages includes a picture of a plant.

11. The wearable book of claim 6, wherein at least one of said pages includes a picture of a fungus.

12. The wearable book of claim 6, wherein at least one of said pages includes a picture of an astronomical object.

13. The wearable book of claim 6, wherein at least one of said pages includes a picture of a rock or mineral.

14. The wearable book of claim 6, wherein said pages comprise synthetic paper.

15. The wearable book of claim 14, wherein said pages comprise more than one layer of synthetic paper where at least one layer is adapted to receive printing inks or toners.

16. The wearable book of claim 5, wherein said information comprises text and pictures disposed on at least one of said plurality of pages.

17. The wearable book of claim 5, wherein said information comprises text, and at least one of said pages includes at least one word in a first language associated with an explanatory word in a second language different from said first language.

18. The wearable book of claim 5, wherein at least one of said pages includes a picture of an animal.

19. The wearable book of claim 5, wherein at least one of said pages includes a picture of a plant.

20. The wearable book of claim 5, wherein at least one of said pages includes a picture of a fungus.

21. The wearable book of claim 5, wherein at least one of said pages includes a picture of an astronomical object.

22. The wearable book of claim 5, wherein at least one of said pages includes a picture of a rock or mineral.

23. The wearable book of claim 5, wherein said pages comprise synthetic paper.

24. The wearable book of claim 5, wherein said pages comprise more than one layer of synthetic paper where at least one layer is adapted to receive printing inks or toners.

25. The wearable book of claim 3, wherein said information comprises text and pictures disposed on at least one of said plurality of pages.

26. The wearable book of claim 3, wherein said information comprises text, and at least one of said pages includes at least one word in a first language associated with an explanatory word in a second language different from said first language.

27. The wearable book of claim 3, wherein at least one of said pages includes a picture of an animal.

28. The wearable book of claim 3, wherein at least one of said pages includes a picture of a plant.

29. The wearable book of claim 3, wherein at least one of said pages includes a picture of a fungus.

30. The wearable book of claim 3, wherein at least one of said pages includes a picture of an astronomical object.

31. The wearable book of claim 3, wherein at least one of said pages includes a picture of a rock or mineral.

32. The wearable book of claim 3, wherein said pages comprise synthetic paper.

33. The wearable book of claim 32, wherein said pages comprise more than one layer of synthetic paper where at least one layer is adapted to receive printing inks or toners.

34. A method for consulting information in at least a potentially wet, outdoor environment, comprising:

providing a substantially waterproof book containing the information;

providing pages having corresponding first edges and being bound together at the first edges by connectors;

connecting said book to a loop;

threading the loop through the connectors;

stretching the loop over a first body portion having a substantially larger circumference than a second body portion, thereafter snugly circumferentially contacting said second body portion with said loop after relaxing said stretching; and wearing said book in the outdoor environment.

35. The method of claim 34, further comprising a step of using said book by viewing a plant in an outdoor environment and comparing the plant as viewed with a picture on at least one of said pages worn in an outdoor environment.

36. The method of claim 34, wherein said step of wearing said book outdoors includes wearing said book underwater.

37. The method of claim 36, further comprising a step of using said book by viewing an animal underwater and comparing the animal as viewed with a picture on at least one of said pages worn underwater.

* * * * *